United States Patent [19]

Nakatani et al.

[11] Patent Number: 4,746,000

[45] **Date of Patent: * May 24, 1988**

[54] CURVED ESCALATOR

[75] Inventors: Hiroshi Nakatani, Inazawa; Makoto Tomidokoro, Ichinomiya; Hiroshi Yoshikawa, Inazawa, all of Japan

[73] Assignee: Mitsubishi Denki Kabushiki Kaisha, Japan

[ * ] Notice: The portion of the term of this patent subsequent to May 5, 2004 has been disclaimed.

[21] Appl. No.: 808,386

[22] Filed: Dec. 16, 1985

Related U.S. Application Data

[63] Continuation of Ser. No. 526,132, Aug. 24, 1983, abandoned.

[30] Foreign Application Priority Data

| | | | |
|---|---|---|---|
| Sep. 14, 1982 | [JP] | Japan | 57-159862 |
| Sep. 14, 1982 | [JP] | Japan | 57-159876 |
| Oct. 19, 1982 | [JP] | Japan | 57-183315 |
| Nov. 2, 1982 | [JP] | Japan | 57-192712 |

[51] Int. Cl.[4] ..... B66B 21/02

[52] U.S. Cl. ..... 198/328; 198/333

[58] Field of Search ..... 198/328, 333, 852; 198/778

[56] References Cited

U.S. PATENT DOCUMENTS

| | | | |
|---|---|---|---|
| 617,779 | 1/1899 | Seeberger | 198/328 |
| 727,720 | 5/1903 | Venn | 198/328 |
| 889,080 | 5/1908 | Wheeler | 198/328 |
| 999,885 | 8/1911 | Seeberger | 198/328 |
| 1,804,701 | 5/1931 | Mojonnier | 198/852 |
| 2,135,188 | 11/1938 | Lindquist | 198/333 |
| 2,641,351 | 6/1953 | Riley | 198/328 |
| 2,695,094 | 11/1954 | Riley | 198/328 |
| 2,823,785 | 2/1958 | Hefti | 198/328 |
| 3,520,398 | 7/1970 | Thomson | 198/852 |
| 3,878,931 | 4/1975 | Luna | 198/328 |

FOREIGN PATENT DOCUMENTS

| | | | |
|---|---|---|---|
| 595744 | 4/1934 | Fed. Rep. of Germany | 198/328 |
| 2809861 | 9/1978 | Fed. Rep. of Germany | 198/328 |
| 25559 | 7/1973 | Japan | 198/328 |

*Primary Examiner*—Joseph E. Valenza
*Assistant Examiner*—Jonathan D. Holmes
*Attorney, Agent, or Firm*—Leydig, Voit & Mayer

[57] ABSTRACT

A curved escalator includes guide tracks for defining a stairway path which includes a constant slope intermediate section, horizontal landing sections, and transient sections smoothly connecting the intermediate section and the landing sections. Each section of differing slope has a differing radius of curvature which when viewed in plan, is inversely proportional to the slope angle, thereby eliminating the need for drive chains to change the distance between the step axles. Turn-around mechanisms that are compact and simple in structure are also disclosed.

5 Claims, 15 Drawing Sheets

CURVED ESCALATOR

This application is a continuation of now abandoned application Ser. No. 526,132, filed Aug. 24, 1983.

BACKGROUND OF THE INVENTION

This invention relates to escalators and more particularly to curved escalators which have a stairway path that is curved in plan.

Typical circular or curved escalators have a stairway path along which a series of steps travel, the path having a constant radius of curvature or circular in plan throughout its entire length including the horizontally-moving landing sections at the upper and lower ends of the escalator. The stairway path is defined by guide tracks that support and guide various rollers mounted on the steps. The guide track on the outer side of the circular stairway path and the guide track on the inner side of the circular stairway path are different in gradient. Therefore, with guide tracks of a constant radius of curvature as in the escalator described above, the distance between the axes of step axles that connect the step to the driving chain must be variable in order that the angular velocities of the step at the outer and inner side of the step be equal even in locations where the angle of slope changes, such as in the transition portions between the load-bearing inclined portion and the upper or lower horizontal landing portion. This requires a complex and expensive driving and guiding arrangement in the escalator.

SUMMARY OF THE INVENTION

Accordingly, the chief object of the present invention is to provide a curved escalator which is simple in structure, less expensive, and free from the above discussed problem.

Another object of the present invention is to provide a curved escalator simple and compact in structure.

Still another object of the present invention is to provide a curved escalator that has simple and compact turn-around portions.

With the above objects in view, the present invention resides in a curved escalator comprising an endless belt, a plurality of segment steps attached to the endless belt, driving means for driving the endless belt in a loop disposed along a stairway path along which the steps travel, and guide means for guiding and supporting the endless belt about said loop including a plurality of guide wheels rotatably mounted on the steps and a guide track disposed along the stairway path and guiding the wheels therealong. The stairway path along which the escalator extends is inclined and curved in plan along, for example, an arc. The stairway path has an upper and a lower horizontal landing section, an intermediate section that has a predetermined, constant slope, and transition sections between the upper and lower landing sections and the intermediate slope section. The radius of curvature of the guide track when viewed in plan is inversely proportional to the slope of the various sections of the stairway path. Thus, if the slope of a section is constant, the radius of curvature of that section is also constant, and if the slope is gradually increasing then the radius of curvature of that section gradually decreases.

With this arrangement, the outer and inner angular speed of the segment steps are equal to each other and there is no need to provide a step chain with a complex mechanism for changing the distance between the step axles, resulting in a simpler and less expensive curved escalator structure.

BRIEF DESCRIPTION OF THE DRAWINGS

The present invention will become more readily apparent from the following description of the preferred embodiments taken in conjunction with the accompanying drawings.

DESCRIPTION OF THE PREFERRED EMBODIMENTS

Figure 1:
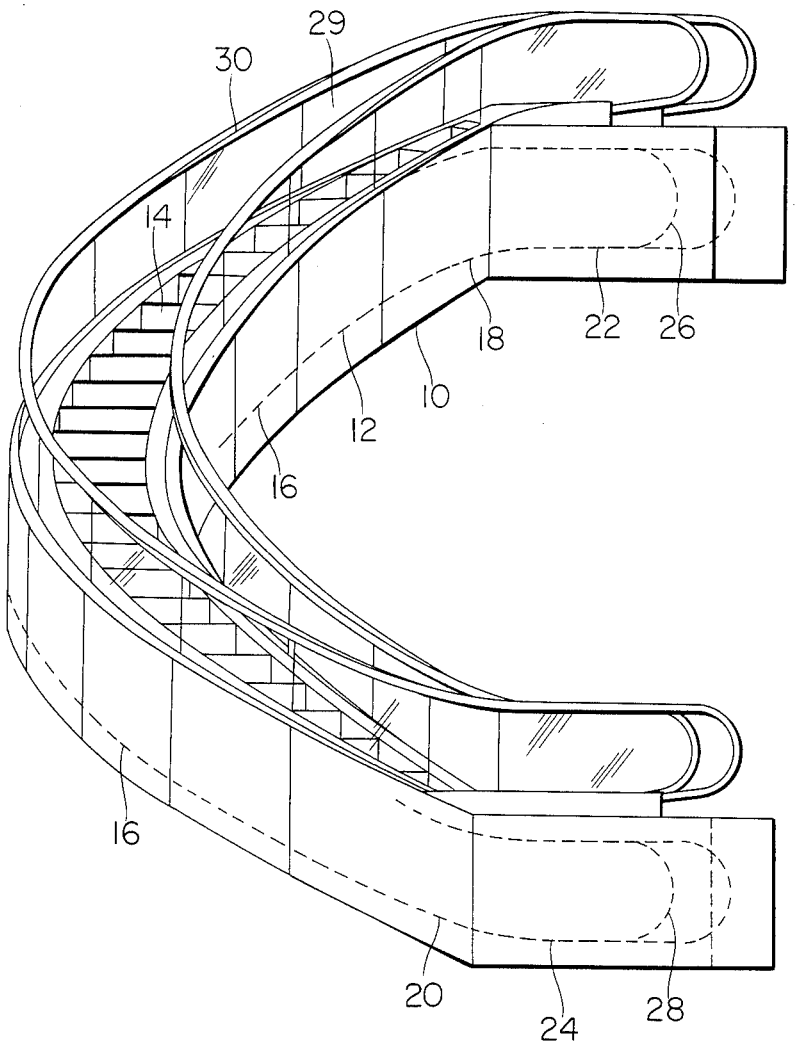
FIG. 1 is a front view of a curved escalator to which the present invention is applicable.
Figure 2:
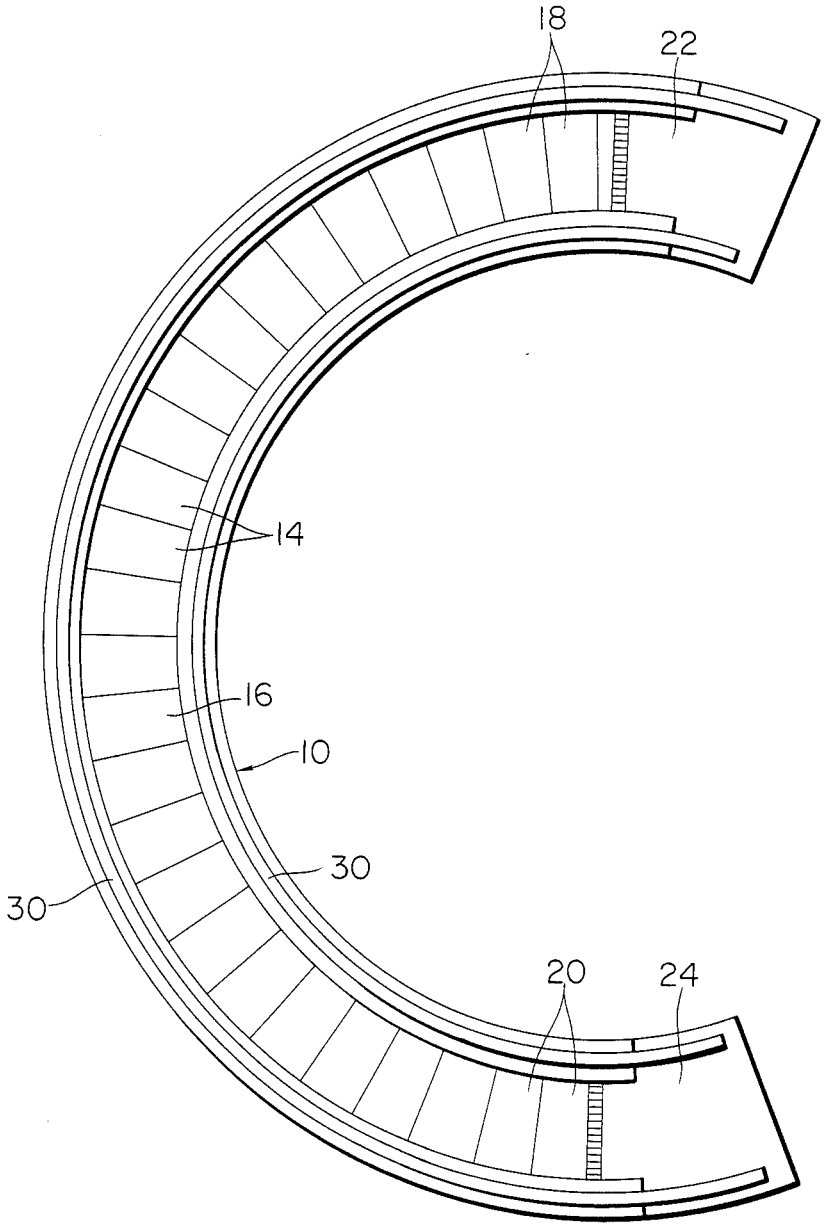
FIG. 2 is a plan view of the escalator shown in FIG. 1.

FIGS. 1 and 2 illustrate a typical curved escalator to which the present invention can be applied. The curved escalator has a general configuration of a spiral or has two ends that are vertically separated and connected by an arc when viewed in plan. The escalator comprises a frame 10 in which an endless belt 12 and driving and guiding mechanism (see FIGS. 5–9) which will be described in more detail later are installed. The escalator also comprises a plurality of steps 14 connected to the endless belt 12. The steps 14 are moved along the endless belt 12 and formed in segments. The curved escalator includes an intermediate portion 16 that is circular in plan view and inclined at a predetermined angle with respect to the horizontal. The intermediate portion 16 constitutes most of the load bearing run of the endless belt means carrying the steps. Both the upper and lower ends of the intermediate portion 16 are connected through upper and lower transition portions 18 and 20, respectively, to substantially horizontal upper and lower landing portions 22 and 24, respectively. The transient portions 18 and 20 smoothly connect the inclined intermediate portion 16 to the horizontal landing portions 22 and 24, so that the transient portions 18 and 20 have inclinations or gradients that gradually change for smooth connection. The extreme end of each of the horizontal landing portions 22 and 24 is provided with a turn-around portion 26 or 28 around which the endless belt 12 changes its travel direction and changes from the load-bearing run to the return run or its reverse.

The curved escalator also comprises a balustrade 29 including a handrail 30 thereon on each side of the escalator.

Figure 3:
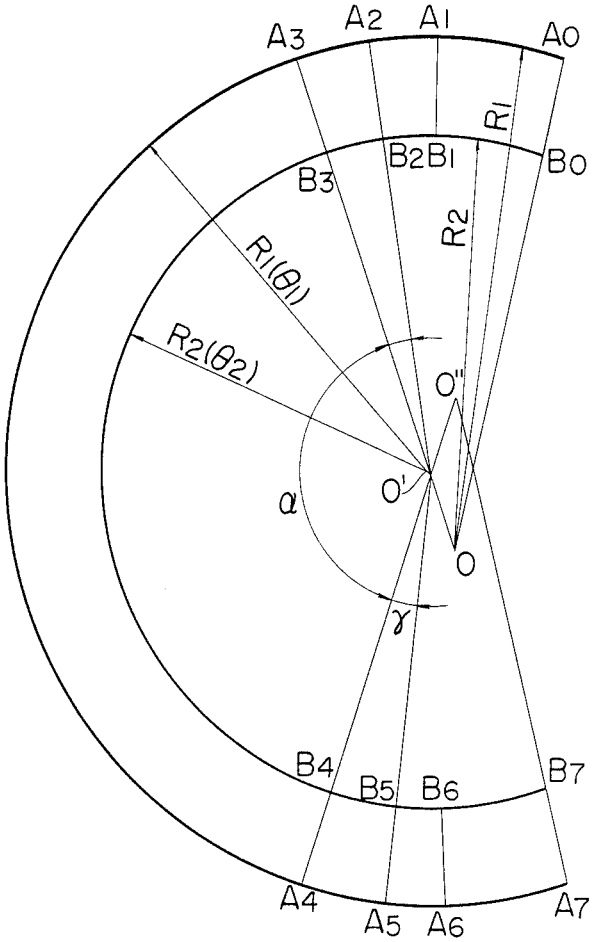
FIG. 3 is a graphical representation of the various radii of curvature of the stairway path viewed in plan.

FIG. 3 is a diagram illustrating the plan configuration of the escalator of the present invention. In FIG. 3, arcs $A_0$-$A_1$-$A_2$-$A_3$-$A_4$-$A_5$-$A_6$-$A_7$ represent the outer guide track for guiding the drive rollers on the outer periphery of the curved escalator, and arcs $B_0$-$B_1$-$B_2$-$B_3$-$B_4$-$B_5$-$B_6$-$B_7$ represent the inner guide track for the inner guide rollers. As will be later explained, the outer and inner guide tracks function to support and guide for rolling thereon the drive rollers mounted on the outer and inner ends of the step axles connecting the segment steps to a driving chain forming part of said endless belt. Arcs $A_0$–$A_2$ and $A_5$–$A_7$ are upper and lower horizontal sections of the outer guide track having a constant radius of curvature of $R_1$, and arcs $B_0$–$B_2$ and $B_5$–$B_7$ are upper and lower horizontal sections of the inner guide track having a radius of curvature of $R_2$. The center of the upper section tracks is O and the center of the lower section tracks is O''. Arcs $A_2$–$A_3$ and $A_4$–$A_5$ are upper and lower transition portions of the outer guide track and arcs $B_2$–$B_3$ and $B_4$–$B_5$ are upper and lower transition portions of the inner guide track. These arcs have changing radii of curvature and their centers also change from O or O'' to O'. Arcs $A_3$–$A_4$ and $B_3$–$B_4$ are constant gradient sections of the outer and inner guide tracks, respectively, which have a common center O' and constant radii of curvature $R_1(\theta_1)$ and $R_2(\theta_2)$, respectively. The positions of the comb plate end of the upper and lower floor panel are shown by lines $A_1$–$B_1$ and $A_6$–$B_6$, respectively, and the segment steps turn around at the areas outside of $A_0$–$B_0$ and $A_7$–$B_7$ with the drive chain meshing with the chain sprocket into the return run extending directly below the load bearing run guide track. The radii of curvature in plan of the outer and inner guide tracks in the return run also gradually decrease from the horizontal section to the constant incline section.

Figure 4:
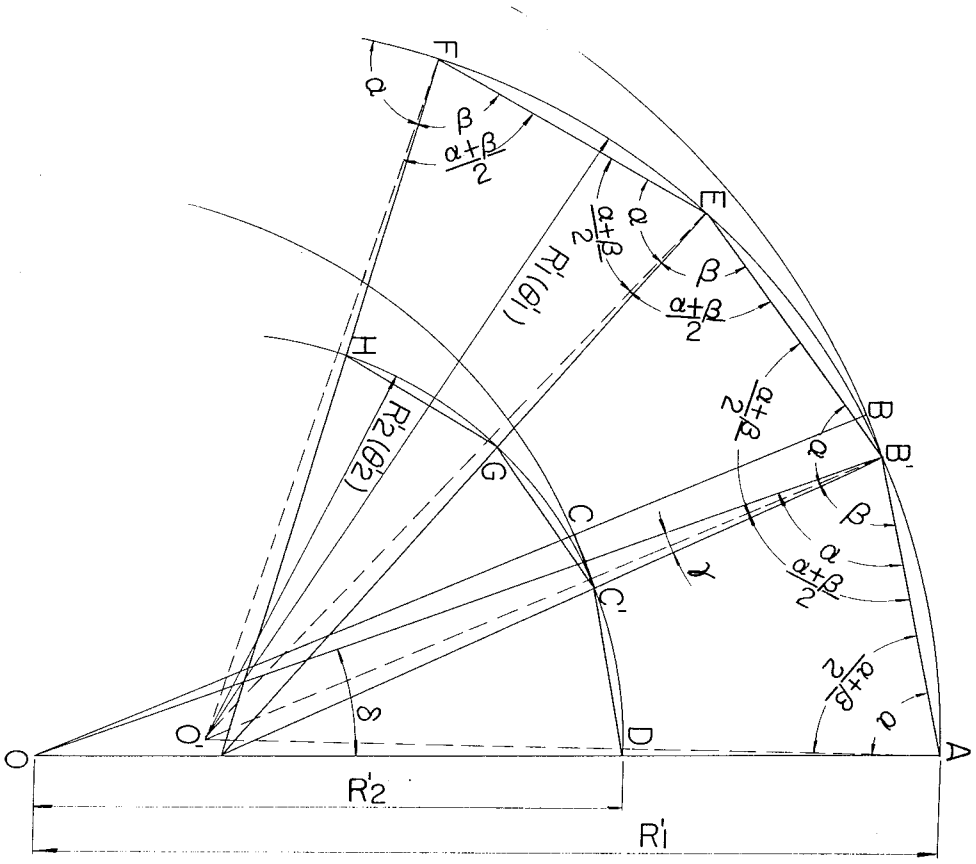
FIG. 4 is a graphical representation of the geometry of the steps of the present invention.

FIG. 4 illustrates the principles of the step formation of the present invention, in which the geometry of the steps is illustrated for the case when the step axles of the adjacent steps are directly connected by a roller chain or a link chain constituting a drive chain.

In the upper and lower horizontal sections, the step top surface can be designated by a segment of a trapezoid ABCD since there is no overlapping portion resulting from the difference in elevation between the adjacent steps. The exposed surface of the steps in the constant inclination section is AB'C'D when the angles of inclination at the portion corresponding to the outer and inner peripheries of the step are $\theta_1'$ and $\theta_2'$, respectively. Thus, the overlapping portion between the adjacent steps is BB'C'C. Then, the exposed surface of the connected steps is a polygon AB'EF . . . DB'GH . . . which is composed of a plurality of trapezoids AB'C'D placed on a plane in a side-by-side relationship. When the radius of a circumscribed circle connecting the outer points AB'EF . . . of the polygon is $R_1'(\theta_1')$ and the radius of a circumscribed circle connecting the inner points DC'GH . . . of the same polygon is $R_2'(\theta_2')$, then the following equation holds true. When $\theta_1'=\theta_2'=0$, the radii of the circumscribed circles on the outer and inner peripheries of the above polygon are $R_1'$ and $R_2'$, respectively, and arc $AB=l_1$ and arc $CD=l_2$.

$$R_1'\delta = \overset{\frown}{AB}\cos\theta_1' = l_1\cos\theta_1' \tag{1}$$

$$\delta = \frac{l_1}{R_1'}\cos\theta_1'$$

If $\angle DAB'=\alpha$, $\angle AB'C'=\beta$, $\angle OB'C'=\gamma$ and $\angle B'OA=\delta$, $$\beta = \alpha - \gamma \approx \alpha - \frac{R_2'\delta - l_2\cos\theta_2'}{R_1' - R_2'} \tag{2}$$

$$\alpha = \frac{\pi - \delta}{2}$$

$$\alpha + \beta = \frac{\pi R_1' - l_1\cos\theta_1'}{R_1'} - \frac{R_2'\,l_1\cos\theta_1' - R_1'\,l_2\cos\theta_2'}{R_1'(R_1' - R_2')}$$

$$R'\cos\frac{\alpha+\beta}{2} = R_1'\sin\frac{\delta}{2} \tag{3}$$

$$R_1'(\theta_1') = \tag{4}$$

$$\frac{R_1'\sin\left(\dfrac{l_1}{2R_1'}\cos\theta_1'\right)}{\cos\left(\dfrac{\pi R_1' - l_1\cos\theta_1'}{2R_1'} - \dfrac{R_2'\,l_1\cos\theta_1' - R_1'\,l_2\cos\theta_2'}{2R_1'(R_1' - R_2')}\right.}$$

-continued $$R_1'(\theta_1') \approx \frac{R_1'(R_1' - R_2')\cos\theta_1'}{R_1'\cos\theta_1' - R_2'\cos\theta_2'}$$

Although the steps between equations (3) and (4) is omitted, equation (4) expresses an approximate value with an accuracy of about 0.01%.

Similarly, $$R_2'(\theta_2') \approx \frac{R_2' - (R_1' - R_2')\cos\theta_2'}{R_1'\cos\theta_1' - R_2'\cos\theta_2'}$$

Therefore, the radius of the outer guide track should be $$R_1(\theta_1) \approx \frac{R_1(R_1 - R_2)\cos\theta_1}{R_1\cos\theta_1 - R_2\cos\theta_2} \quad (5)$$

and the radius of the inner guide track should be $$R_2(\theta_2) \approx \frac{R_2(R_1 - R_2)\cos\theta_2}{R_1\cos\theta_1 - R_2\cos\theta_2} \quad (6)$$

Thus, when the gradients or the inclinations of the outer and the inner guide tracks are $\theta_1$ and $\theta_2$ respectively, and the steps are to be supported and guided in the intermediate constant inclination section, the circular guide tracks should have radii of curvature $R_1(\theta_1)$ and $R_2(\theta_2)$ and a center O'. When the steps are to be guided in the upper and lower horizontal sections, the guide tracks for guiding the steps should have a center O or O'' with radii of curvature $R_1$ and $R_2$. Since the inclination is constant in the intermediate constant inclination section, the radii of curvature of the guide tracks are also constant, and the radii of curvature of the guide tracks in the upper and lower transition sections vary according to equations (5) and (6) with varying $\theta_1$ and $\theta_2$.

FIGS. 5 to 9 illustrate one embodiment of the curved escalator of the present invention. The escalator comprises an outer drive chain 32 and an inner drive chain 34 which constitute the endless belt 12 shown in FIG. 1. The outer and inner chains 32 and 32 are connected to a step axle 36 mounted on each of the steps 14, and each end of the step axle 36 has mounted thereon a rotatable drive roller 38. The drive rollers 38 are supported and guided on outer and inner guide tracks 40 and 42 fixedly mounted on the truss or frame 10 of the escalator. The step 14 also has another axle on which follower rollers 44 are rotatably mounted. The follower rollers 44 are also supported and guided by guide tracks 46 and 48 secured on the frame 10.

Figure 5:
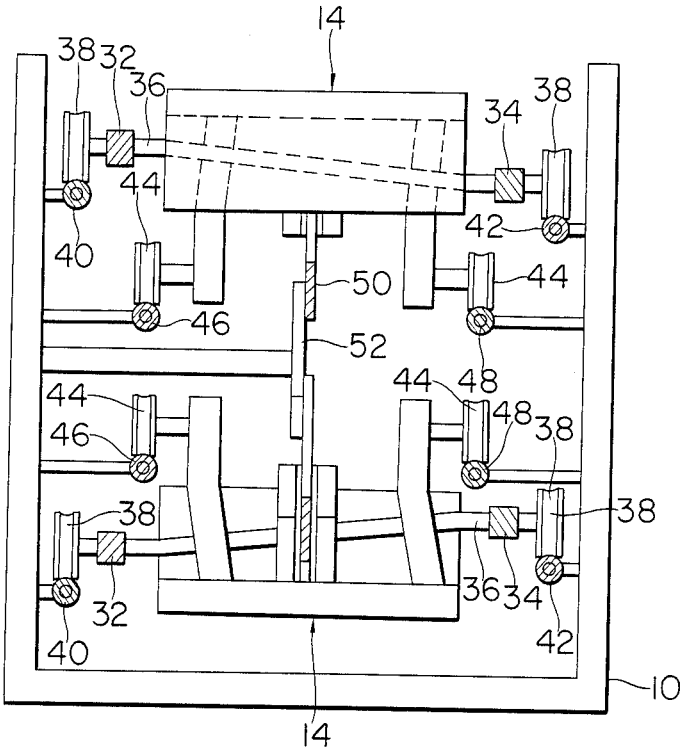
FIG. 5 is a schematic sectional view illustrating the driving and guiding mechanism of a curved escalator according to the present invention.
Figure 6:
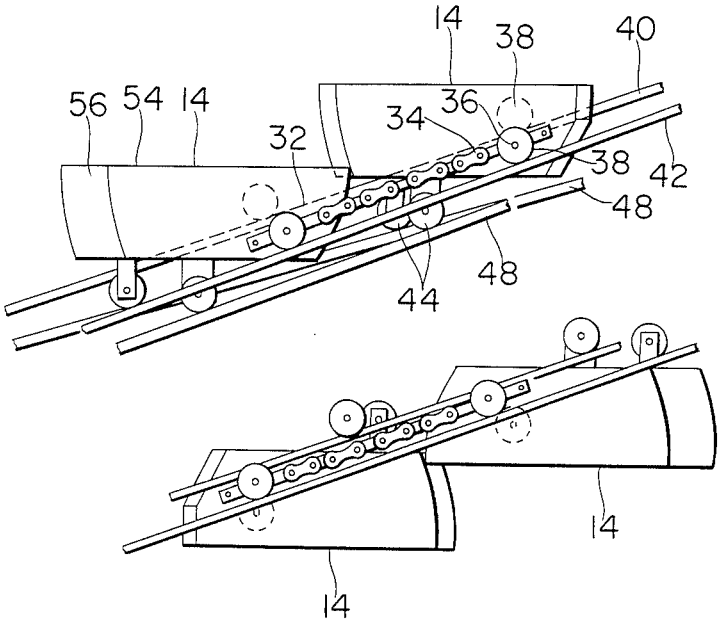
FIG. 6 is a side view of the steps and the guide means of a curved escalator according to the present invention.
Figure 7:
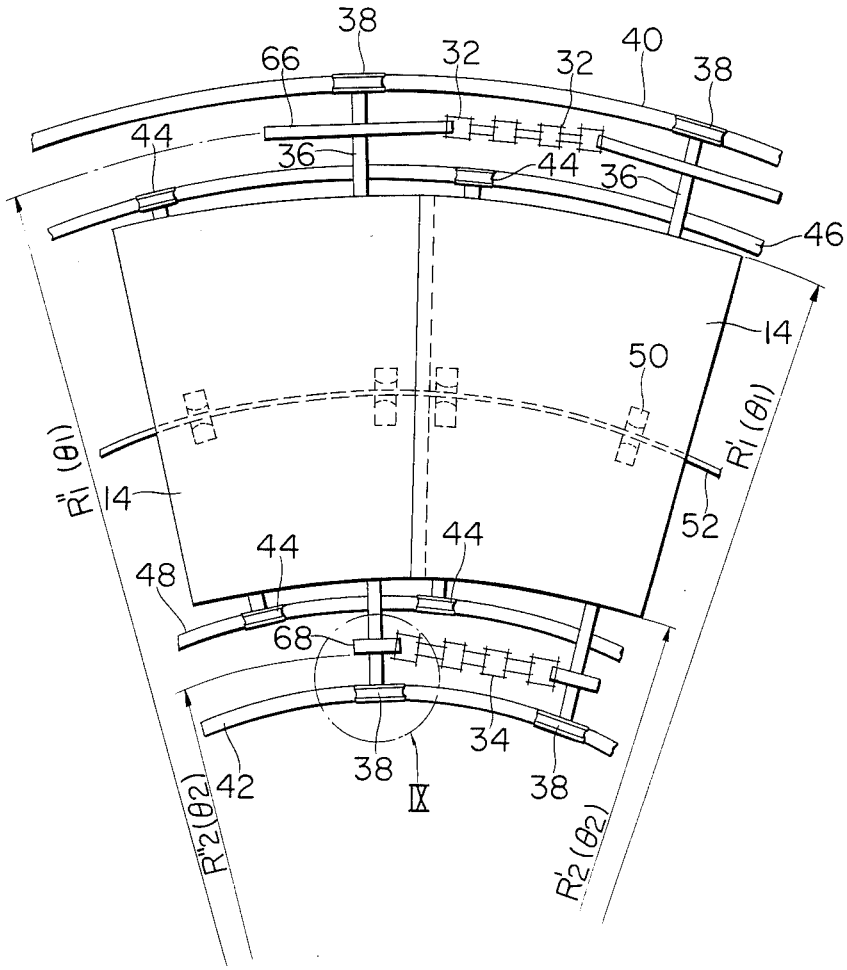
FIG. 7 is a plan view of the steps and the guide means of a curved escalator according to the present invention.

As shown in FIGS. 5 to 7, the step axle 36 supporting the segment step 14 through an attachment that is not illustrated is constructed to have staggered end portions so that the outer drive roller 38 is positioned higher than the inner drive roller 38 in the load bearing run. Therefore, the guide tracks 40 and 42 for supporting and guiding the respective drive rollers 38 are also positioned at differing levels. The outer and inner chains 32 and 34 driven by a drive mechanism, which will be described in detail later, cause the steps 14 to be driven along the guide tracks 40 and 42. The follower rollers 44 on the guide tracks 46 and 48 are disposed below and interior to the drive rollers 38 and function, in cooperation with the guiding function of the drive rollers 38 and the guide tracks 40 and 42, to maintain a desired horizontal position of the steps 14 while they are travelling in the load bearing run and the return run of the endless belt. The outer guide tracks 40 and 46, and the inner guide tracks 42 and 48 are arranged according to the previously described relationship between the radius of curvature and the inclination of the escalator, i.e. the radii of curvature of the guide tracks are inversely proportional to their inclination, whereby the step axles 36 can be directly connected to the outer and inner drive chains 32 and 34. The steps 14 also have on their reverse side a guide shoe 50 or a wheel in engagement with a guide track 52 centrally disposed and rigidly mounted on the frame 10 of the escalator. The guide shoe 50 moves along the track 52 to limit lateral movements of the steps 14.

As shown in FIG. 6, each step 14 has formed thereon a tread 54 and a riser 56 which include a plurality of cleats (not shown) extending perpendicular to the surface of the tread part 54 and meshing with the cleats (not shown) on the tread part 54.

Figure 8:
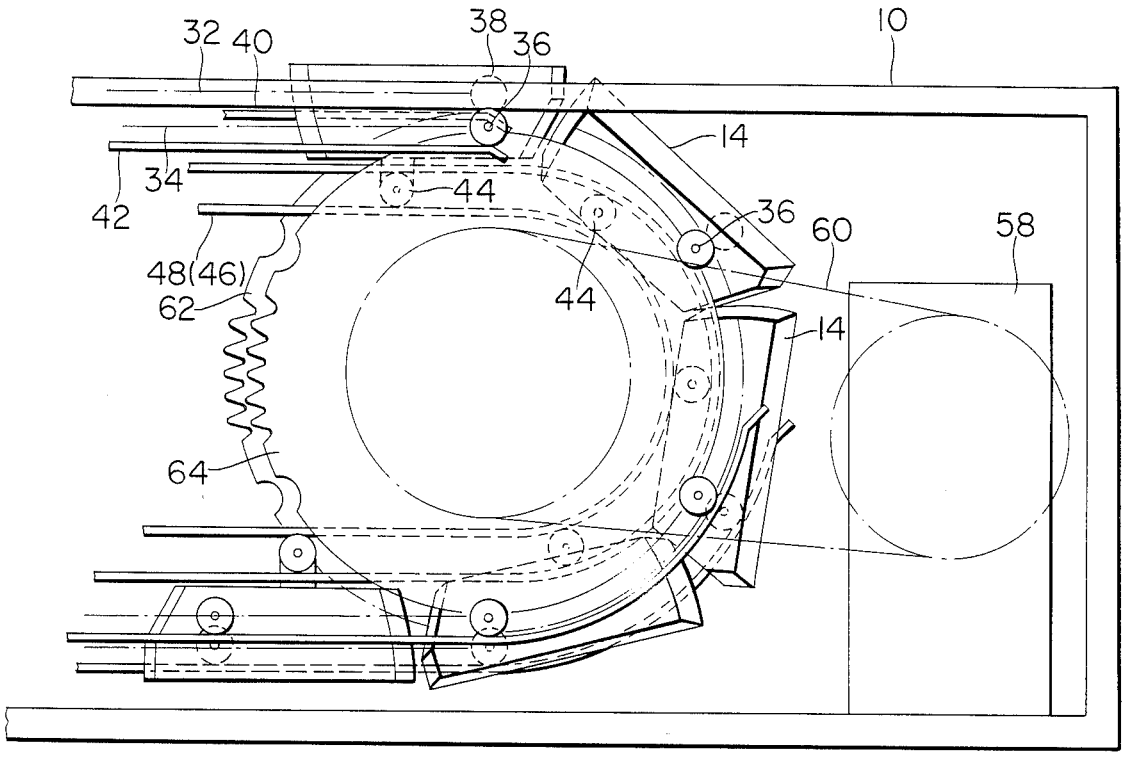
FIG. 8 is a side view of the driving chain sprocket wheels of a curved escalator according to the present invention.

The drive mechanism for driving the endless belt of the escalator comprises an electric motor 58 for driving, through a drive chain 60, chain sprockets 62 and 64 as shown in FIG. 8 in which the turn-around portion of the endless belt is illustrated together with the driving mechanism. As illustrated, the outer and inner drive chains 32 and 34 are wound around the larger and the smaller chain sprockets 62 and 64, respectively. The pitch circle of the larger sprocket 62 which engages the outer chain 32 is larger than that of the smaller sprocket 54 engaging the inner chain 34 by an amount that is determined by the ratio of the radii of curvature $R_1''$ and $R_2''$ of the chains in the horizontal landing portion of the endless belt, so that the outer and the inner chains 32 and 34 are assured to be driven at the same constant angular velocity.

It is to be noted that the lower turn-around portion of the curved escalator has a set of larger and smaller follower chain sprockets that are similarly dimensioned to those just described to guide the outer and inner driving chains, respectively. The lower set of follower chain sprockets are mounted on a movable platform that is movable along articulated tracks in accordance with the elongation of the chains so that a predetermined necessary tension is provided in the chains. Such a chain tensioner arrangement may be a conventional one known in the art.

In the turn-around portion of the endless belt, the step axles 36 turn about the sprocket shaft (not shown) on a truncated conical surface.

The vertical distance h between the positions of the ends of the step axles 36 is expressed by the following equations when the radii of the outer and inner chain sprockets 62 and 64, respectively, are $r_1$ and $r_2$, and the radii of curvature of the outer and inner chains in the horizontal section are $R_1''$ and $R_2''$, respectively:

$$h = r_1 - r_2$$

$$r_1/r_2 = R_1''/R_2''$$

Figure 9:
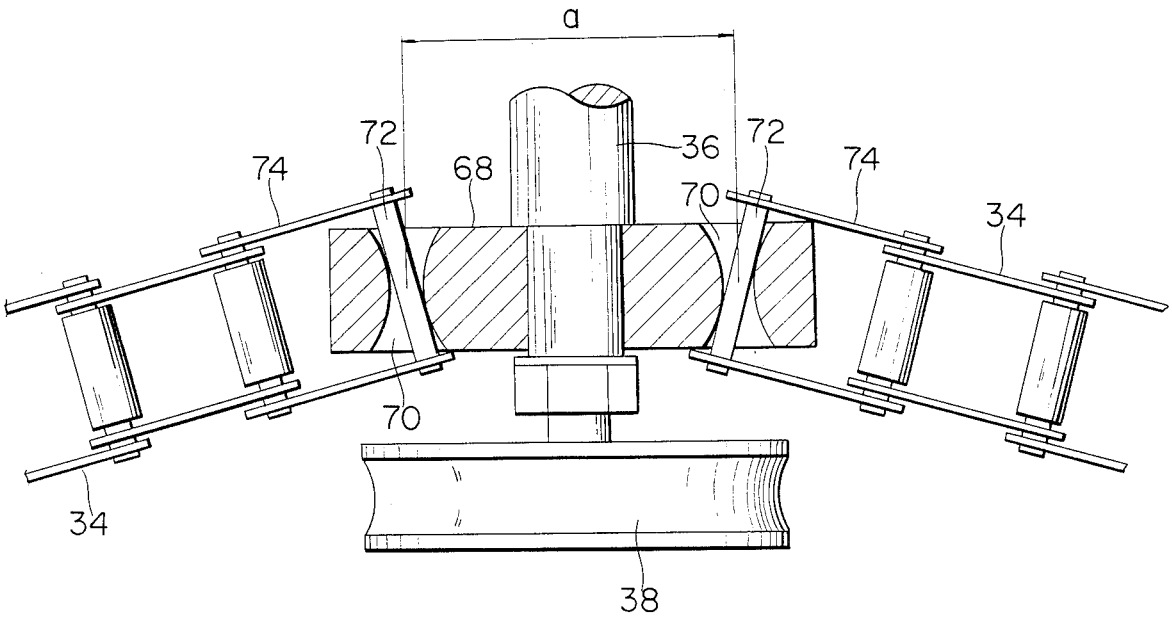
FIG. 9 is a view illustrating the connecting plate of a curved escalator according to the present invention.

As shown in FIGS. 7 and 9, the endless belt includes an outer connecting plate 66 and an inner connecting plate 68 mounted on the outer and the inner end portions of the step axle 36, respectively. The connecting plates 66 and 68 are of similar construction except that their lengths measured in the direction of the chain extension are different. As best seen in FIG. 9, the connecting plate 68 has through holes 70 at opposite ends thereof through which a pin 72 between chain links 74 at the end of the chain 34 extends. It is to be noted that each of the through holes 70 in the ends of the connecting plate 68 is defined by an inwardly convex curve which is rotated about the axis of the hole 70. Also the distance a between the centers of the through holes 70 in the connecting plate 68 is selected so that it is not equal to a pitch p of the outer or inner chain multiplied by an integer. The reason that this distance should not be equal to an integral multiplicity of the chain pitch p is that, in the actual design of the escalator, the ratio $l_1'/l_2'$ of the distances between the adjacent step axles of the outer and the inner driving chains must be selected to equal the radius ratio $r_1/r_2$ of the chain sprockets in the horizontal section of the endless belt, and if the distance a is selected to be np (p multiplied by an integer), the distance in the width-wise direction between the outer and the inner driving chains 32 and 34 must be considerably large in order to obtain a practical design. On the other hand, if the distance a between the centers of the through holes 70 is not equal to the chain pitch p, the width-wise dimension w between the outer and the inner driving chains 32 and 34 can be any desired value.

Although not illustrated, the moving handrail is driven by a drive force from the chain sprocket wheels disposed in the turn-around portion of the escalator. This arrangement enables a continuous handrail to be driven without an angular velocity differential and without the need for a variable speed moving handrail.

As apparent from the foregoing description, in the escalator of the present invention, the radii of curvature when viewed in plan of the guide track in various sections including the horizontal landing section, the transition section, and the constant slope intermediate section are inversely proportional to the slope angle at any position. Also the guide tracks of the above arrangement support and guide the driving rollers mounted on the step axle of the steps. Therefore, the step axles can be directly connected to the driving chains for the travel of the steps, resulting in a simple structure, an easy limitation of the dimensional relationship between the adjacent steps, and a reliable, less expensive structure which is easily manufactured because the step axles are arranged in symmetry with respect to a horizontal axis in the load-bearing and the return runs.

FIGS. 10 to 13 illustrate another embodiment of the curved escalator of the present invention in which a new and improved arrangement is employed for a compact turn-around of the excalator. The curved escalator of the second embodiment comprises a plurality of steps 80 having a tread 82, a riser 84 and side face 86. Each of the steps 80 mounted thereon a step axle 88 projecting at its opposite ends from the side faces 86 of the step 80 and includes at its extremities a drive roller 90. The drive rollers 90 are supported and guided by an outer guide track 92 and an inner guide track 94 fixedly mounted on an escalator frame 96. Also fixedly mounted on the frame 96 are outer and inner guide tracks 98 and 100 for supporting and guiding the follower rollers 102 mounted on the step 80. It can be seen from FIG. 10, that the follower rollers 102 and therefore the follower roller guide tracks 98 and 100 are positioned below and inwardly of the driving roller guide tracks 92 and 94.

It is to be noted that a control lever arm 104 is rotatably mounted on the step axle 88 at its outer end portion, and a shorter end of the arm 104 is connected to an outer driving chain 106 through a connecting pin 108, and a longer end of the arm 104 has mounted thereon a control roller 110 that travels along a control guide track 112 disposed closely to the follower roller outer guide track 98. An inner chain 114 is connected to each of the step axles 88.

Figure 13:
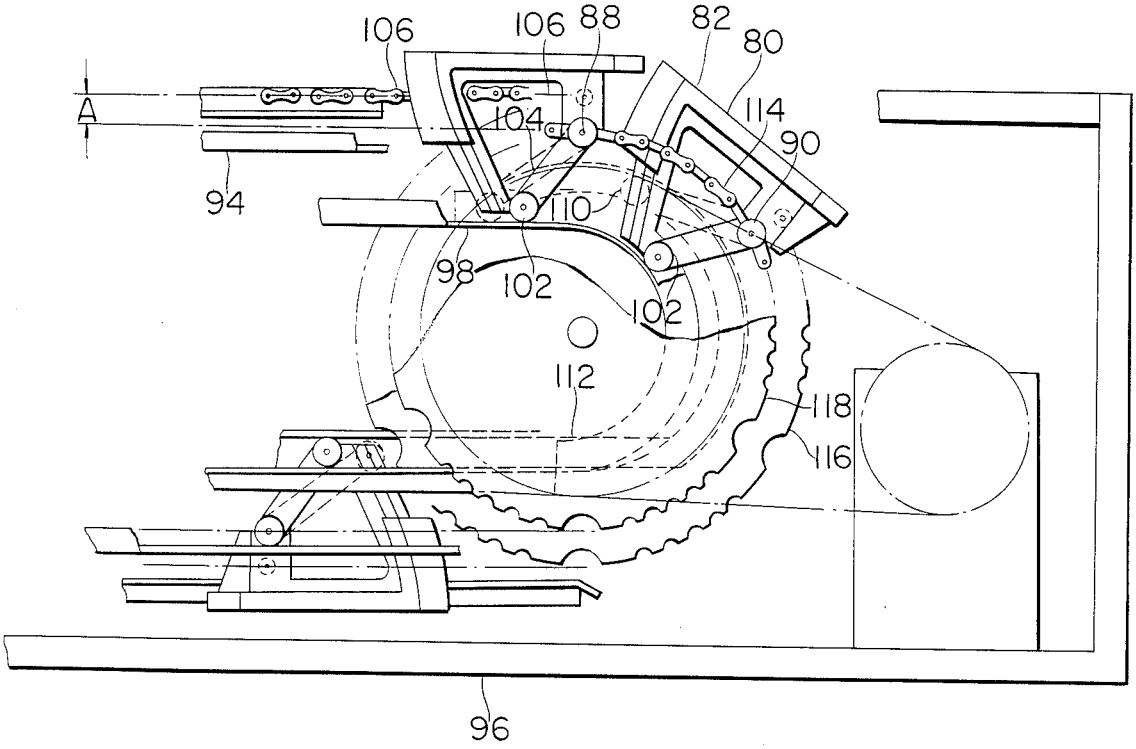
FIG. 13 is a side view of the turn-around portion of the embodiment of the present invention shown in FIG. 10.
Figure 14:
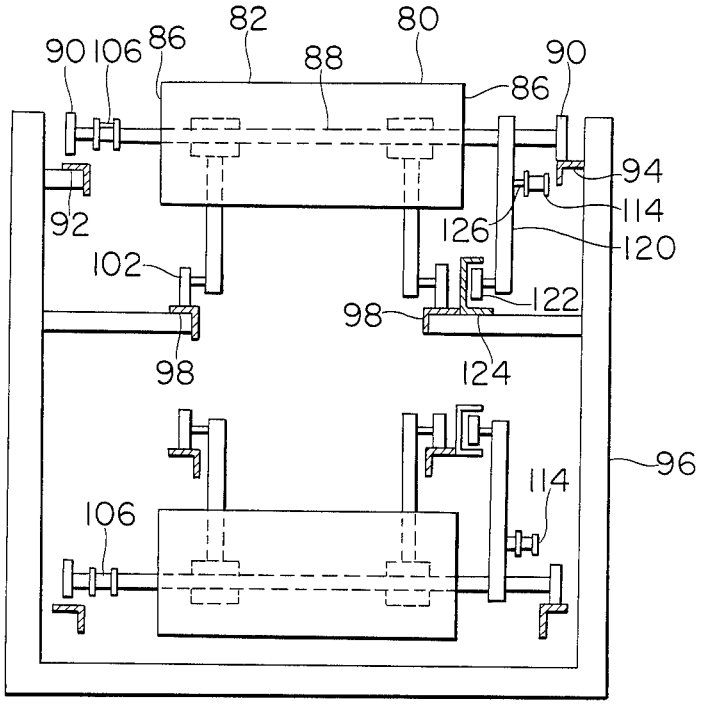
FIG. 14 is a sectional view of a third embodiment of the escalator of the present invention illustrating the driving and guiding mechanism of the escalator.
Figure 15:
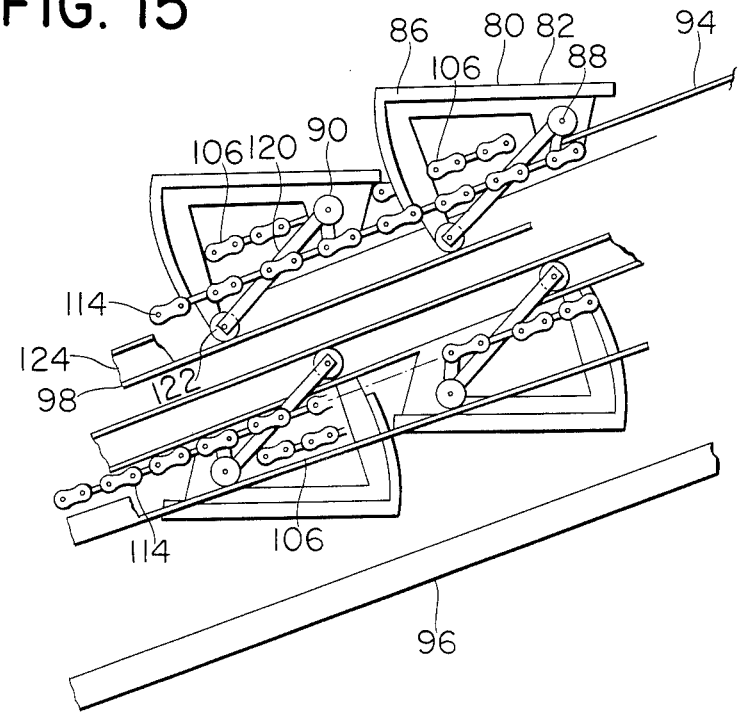
FIG. 15 is a partial side view showing the steps and guiding mechanism of the escalator shown in FIG. 14.
Figure 16:
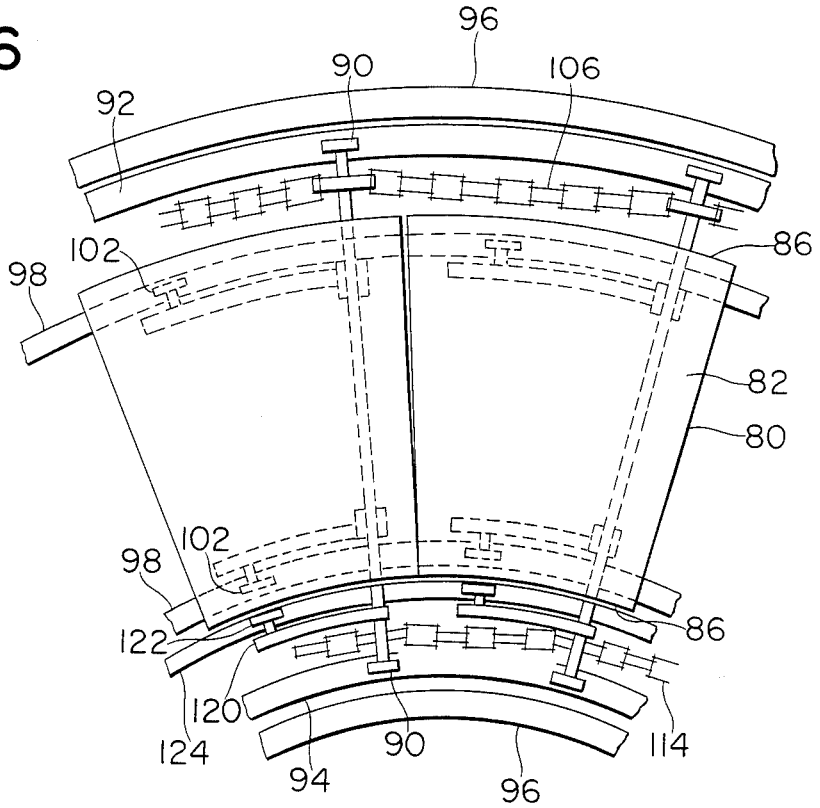
FIG. 16 is a partial plan view showing the steps and guiding mechanism of the escalator shown in FIG. 14.
Figure 17:
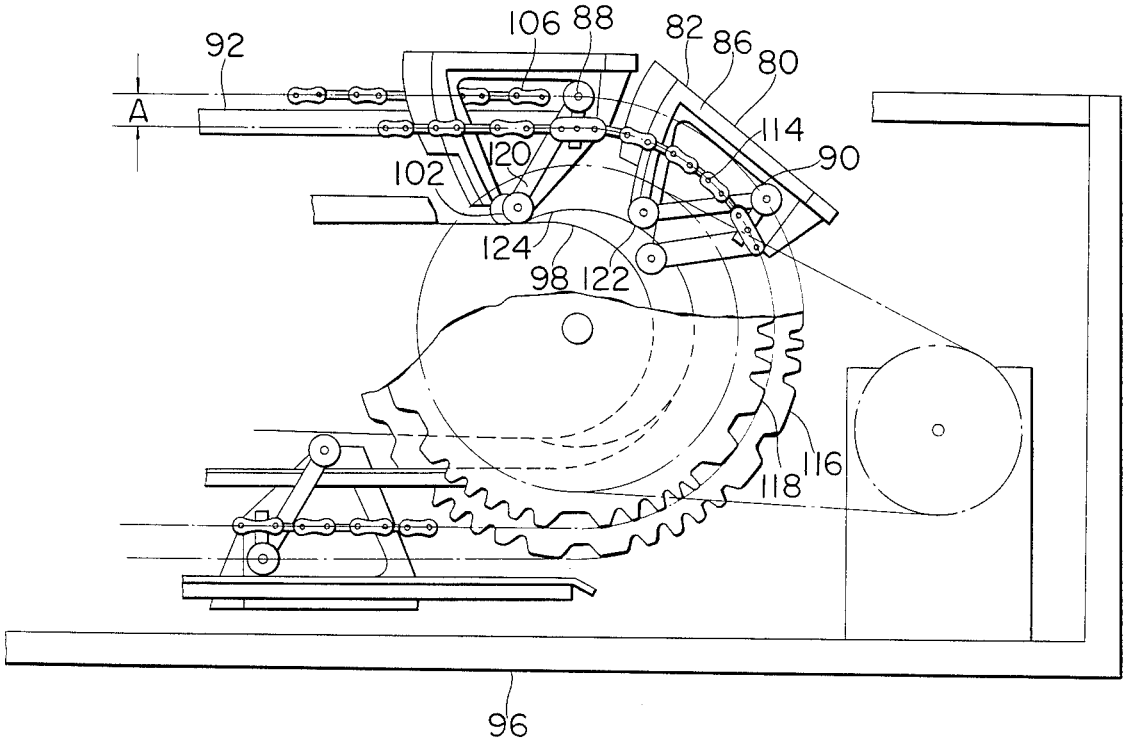
FIG. 17 is a partial side view of the turn-around portion of the excalator shown in FIG. 14.

FIG. 13 illustrates a turn-around portion of the escalator of the present invention. The turn-around portion includes a larger and a smaller chain sprockets 116 and 118 around which the outer and the inner chains 106 and 114, respectively, are wound. It is also seen that a drive mechanism including an electric motor, a drive chain, and chain sprockets is disposed for driving the sprockets 116 and 118.

As described previously, the steps 80 are connected at the inner side of the curved stairway path to the inner endless chain 114 via the step axle 88 and the outer side of the curved stairway path of the escalator is connected to the outer endless chain 106 via the connecting pin 108, the lever arm 104, and the step axle 88. Therefore, when the drive mechanism shown in FIG. 13 is energized, the outer and the inner driving chains 106 and 114 drive the steps 80 along the guide tracks on which the steps 80 are supported and guided through various guide rollers. It is to be noted that since the step axle 88 that is connected to the outer chain 106 is connected through the lever arm 104, the position of the outer driving chain 106 with respect to the step 80 at the outer side of the stairway path is higher than the position of the driving chain 114 on the inner side of the step 80 by a distance A which is expressed by the following equation:

$$A = r_2 \cdot (R_1/R_2 - 1)$$

where, $r_2$: is the pitch circle radius of the smaller sprocket 118, $R_1$: is the radius of curvature of the center line of outer driving chain 106, and $R_2$: is the radius of curvature of the center line of the inner driving chain 114.

Figure 10:
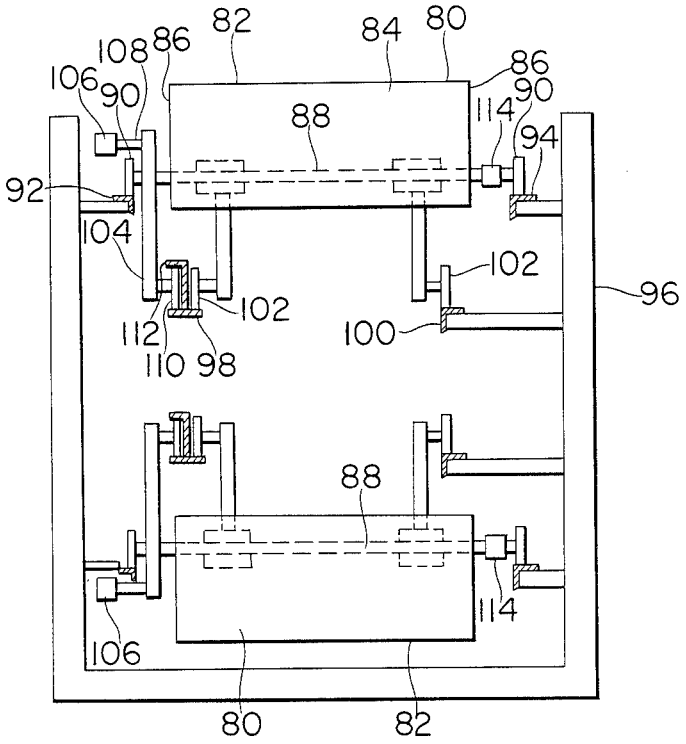
FIG. 10 is a view schematically illustrating the guiding arrangement of another embodiment of a curved escalator.
Figure 11:
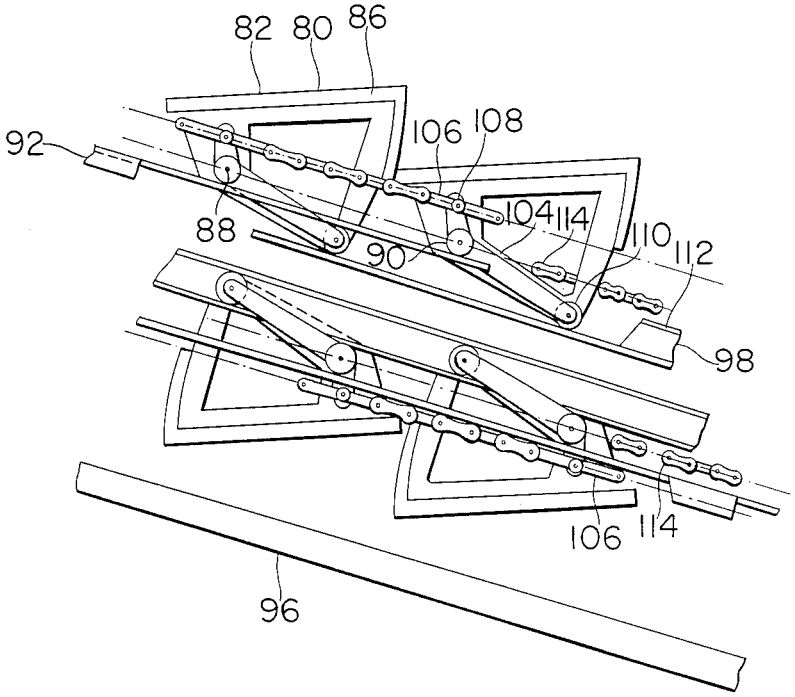
FIG. 11 is a view illustrating the steps and the driving and guiding arrangement of the embodiment shown in FIG. 10.
Figure 12:
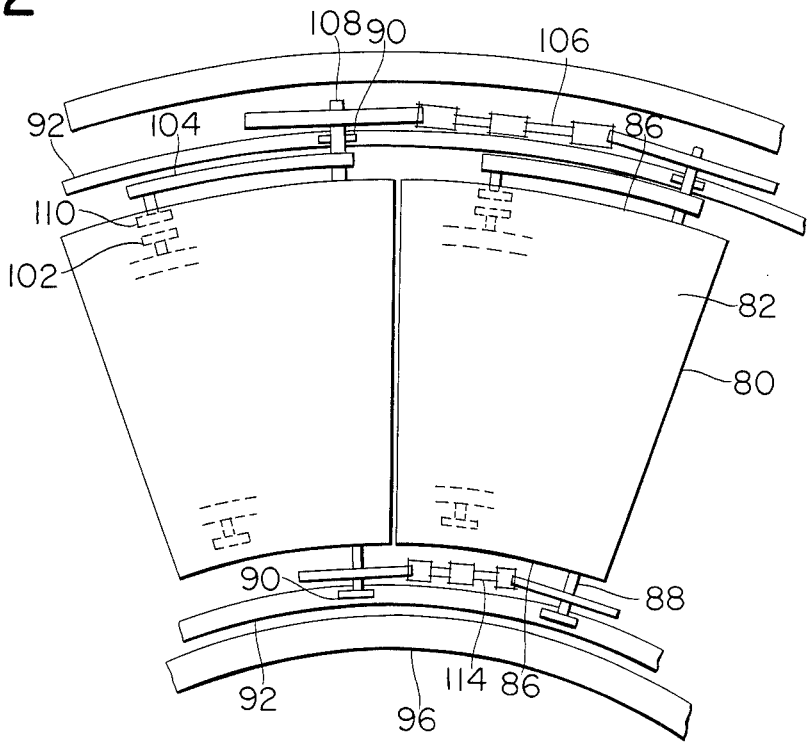
FIG. 12 is a plan view of the steps and the guide means of the embodiment of a curved escalator shown in FIG. 10.

As seen from FIGS. 10 and 13, the outer chain 106 turns around about the larger diameter sprocket 116 and the inner chain 114 turns around about the smaller sprocket 118 so that it may be said that a straight line connecting a point on the outer and the inner chains turns to describe a truncated conical surface at the turn-arounds. According to the present invention, however, the steps 80 are rotatably connected to the outer and the inner driving chains 106 and 114, and the follower rollers 102 mounted on the step 80 are supported and guided by the guide tracks 98 and 100 so that the steps 80 in the turn-around portion of the escalator are regulated to move along a cylindrical plane rather than a conical surface. Also as the steps 80 move along the stairway path, the regulating roller 110 is also guided by the regulating track 112 to regulate the positional relationship of the lever arm 104 with respect to the side face 86 of the step 80.

Although the guide tracks 92, 94, 98, and 100 must be formed in an accurate spiral form and positioned in exact positions, particularly in the load bearing run, and if there is any displacement of the guide tracks the steps 80 tend to interfere with each other or create clearances between the steps 80, the proper positioning of the regulating track 112 to suitably move the lever arm 104 with respect to the step 80 enables the steps 80 to travel with a proper positional interrelationship maintained between the steps 80.

In summary, according to the second embodiment of the present invention, the inner side of the steps disposed in a stairway path curved in plan and inclined is connected to the inner driving endless chain via the step axle rotatably mounted on the step and the outer side of the steps is connected to the outer chain via the connecting pin carried on the lever arm pivotaly mounted on the step axle at the position higher than the inner chain. Also, the position of the lever arm with respect to the step is regulated by the regulating roller and the regulating track which support and guide the regulating roller, and a turn-around mechanism is provided which allows the steps to be turned around along a cylindrical surface whereas the outer and the inner driving chain are wound around chain sprockets of differing diameter. With this arrangement of the second embodiment of the present invention, the turn-around mechanism of the curved escalator is simple and compact in structure, decreasing the frame size. Also, since the abnormalities such as interference of the steps and creation of clearances between the steps due to the manufacturing and assembling error of the steps can be corrected by the regulating track and the regulating roller through the lever arm, the curved escalator is accurate and reliable.

FIGS. 14 to 17 illustrate the third embodiment of the curved escalator of the present invention which is similar to the second embodiment described in conjunction with FIGS. 10 to 13. The curved escalator shown in FIGS. 14 to 17 is different from that shown in FIGS. 10 to 13 in the arrangement of the regulating lever arm 120. The lever arm 120 is rigidly mounted at its one end on the inner side of the step axle 88 of the step 80 and rotatably carries at the other end a regulating roller 122 which is supported and guided by a regulating track 124. It is to be noted that the inner driving chain 114 is connected to the midpoint of the lever arm 120 through a connecting pin 126 at a level lower than the outer driving chain 106 by an amount A just as in the previous embodiment. With this arrangement in which the lever arm is disposed on the inner side of the curved stairway path, an additional advantage is obtained in that the depth of the step 80 can be made small due to the step axle 88 being disposed close to the tread 82 of the step 80, enabling the depth of the truss or frame to be small. Also, since the driving rollers 90 on the step axle 88 are positioned outside of the driving chains 106 and 114, access to the driving rollers 90 for exchange or maintenance can be easily gained in the turn-around potion of the escalator.

Figure 18:
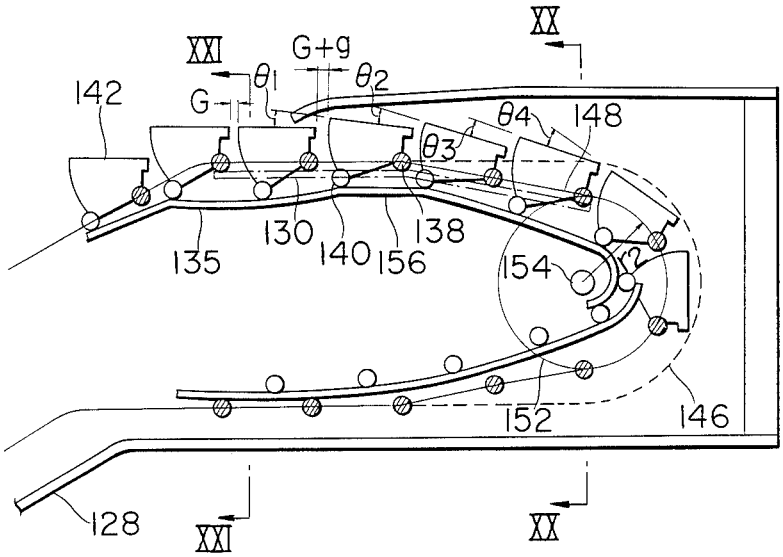
FIG. 18 is a partial schematic side elevation of the horizontal landing section and the turn-around section of the inner side of a fourth embodiment of a curved escalator according to the present invention.
Figure 19:
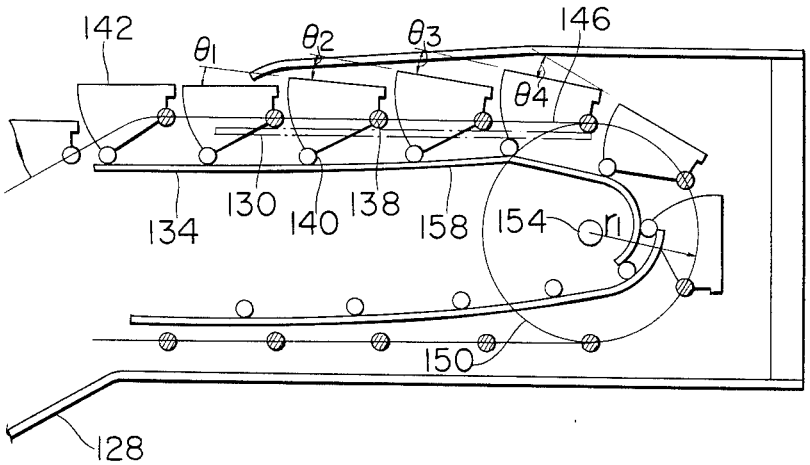
FIG. 19 is a view similar to FIG. 18 but showing the elevation of outer side of the curved escalator shown in FIG. 18.
Figure 20:
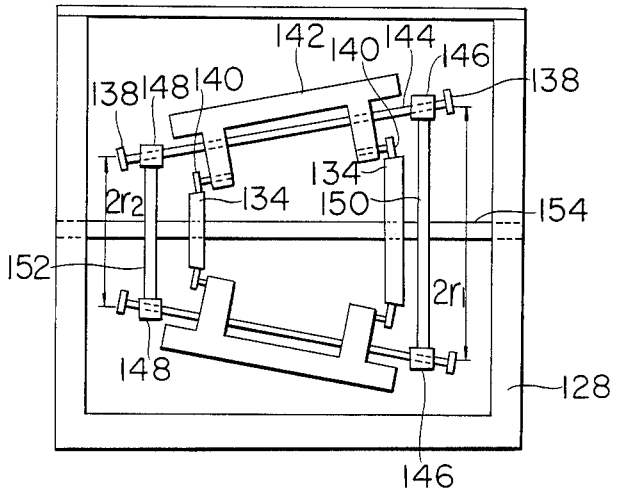
FIG. 20 is a sectional view taken along line XX—XX in FIG. 18 showing the driving and guiding mechanism at the turn-around section of the curved escalator of the present invention.
Figure 21:
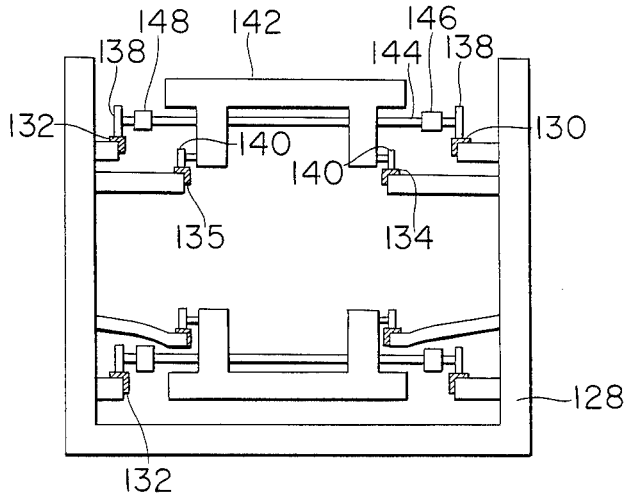
FIG. 21 is a sectional view taken along line XXI—XXI of FIG. 18 showing the section at the load-bearing and the return runs.

FIGS. 18 to 24 illustrate a fourth embodiment of the curved escalator constructed in accordance with the present invention. FIG. 18 schematically shows the turn-around portion on the inner side of the escalator while FIG. 19 shows the same portion as FIG. 18 on the outer side of the curved escalator. FIG. 20 illustrates a section taken along the line XX—XX in FIG. 18 showing the turn-around mechanism, and FIG. 21 illustrates a section of the escalator at the line XXI—XXI in FIG. 18. In these figures, it is seen that the curved escalator comprises a frame 128 which supports various guide tracks including an outer guide track 130, an inner guide track 132, and a pair of follower roller guide tracks 134 and 135. These guide tracks support and guide their respective rollers including driving rollers 138 and follower rollers 140 to maintain proper position of a plurality of segment steps 142 that rotatably carry the driving rollers 138 by a step axle 144. It is seen that outer and inner endless driving chains 146 and 148 are connected to the step axle 144. The driving chain 146 is wound around a larger chain sprocket wheel 150 (radius $r_1$) as shown in FIG. 19 and the inner driving chain 148 is wound around a smaller sprocket wheel 152 (radius $r_2$) shown in FIG. 18. This relationship is also shown in FIG. 20. The larger and smaller sprockets 150 and 152 are connected by a rotatable shaft 154 which is driven by a drive mechanism similar to those described in conjunction with the previous embodiments.

As shown in FIGS. 18 and 19, the guide tracks 134 and 135 for guiding the follower rollers 140 on the step 142 have regulating sections 156 and 158, respectively. The sections 156 and 158 are integral parts of the guide tracks 134 and 135, respectively, and are rigidly supported by the frame 128. The track sections 156 and 158 function to displace the follower rollers 134 and 135 in the upper direction or in the direction away from the center line of the truss frame 128. The track sections 156 and 158 terminate at positions just beyond the shaft of the sprocket wheels 150 and 152 after partially encircling the shaft and other bank tracks 160 and 162 which are integral parts of the return run guide tracks 134 and 135 are disposed to subsequently support and guide the follower rollers 134 and 135 for the smooth travel of the steps.

Figure 23:
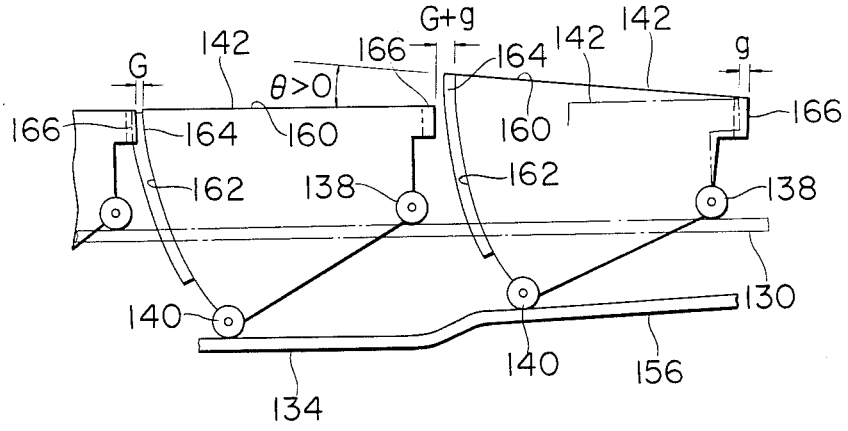
FIG. 23 is a schematic drawing illustrating the function of the regulating track against the steps of the escalator of FIG. 18 according to the present invention.

As best shown in FIG. 23, each step 142 includes a tread 160 and a riser 162, and the riser 162 includes a plurality of cleats 164 which mesh with cleats 166 formed on the opposite end of the adjacent step 142. These cleats 164 and 166 are kept in meshing relationship in the upper and lower runs of the escalator with a gap G between the adjacent steps. When the steps 142 are in the turn-around portion of the stairway path, the follower rollers 140 are lifted with respect to the guide rollers 138 by a predetermined angle $\theta$ by the regulating tracks 156 and 158 to rotate the step 142 about the rollers 138. This rotation of the step 142 causes the gap G between the steps 142 to increase by a distance g, the turn around portion becomes G plus g and the meshing relationship between the cleats is not maintained as shown in FIG. 23.

Figure 24:
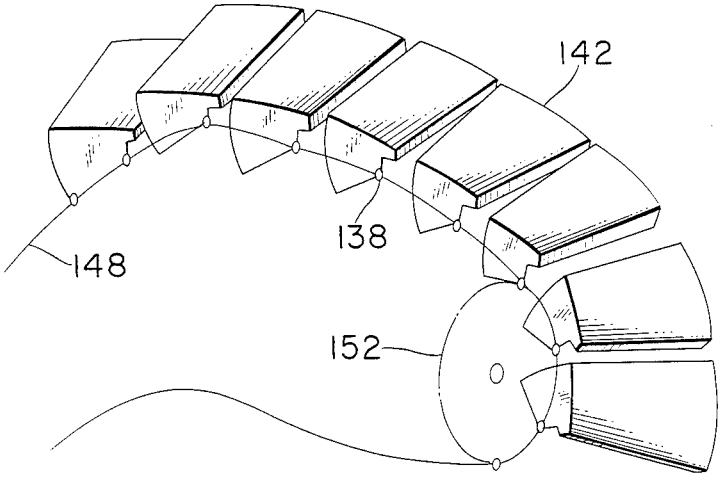
FIG. 24 is a simplified perspective view of a series of steps in the landing and turn-around sections of the curved escalator of the embodiment of FIG. 18 of the present invention.

In order to smoothly move the steps 142 along a turncated conical surface as shown in FIG. 24 in the turn-around portion of the endless belt means of the escalator, the following relationship should be maintained:

$$r_1 : r_2 = R'_1 : R'_2$$

where, $R'_1$: radius of curvature in plan of the inner chain 148 in the intermediate and horizontal sections of the stairway path $R'_2$: radius of curvature in plan of the outer chain 146 in the intermediate and horizontal sections of the stairway path $r_1$: radius of the smaller chain sprocket 152

$r_2$: radius of the larger chain sprocket 150.

Figure 22:
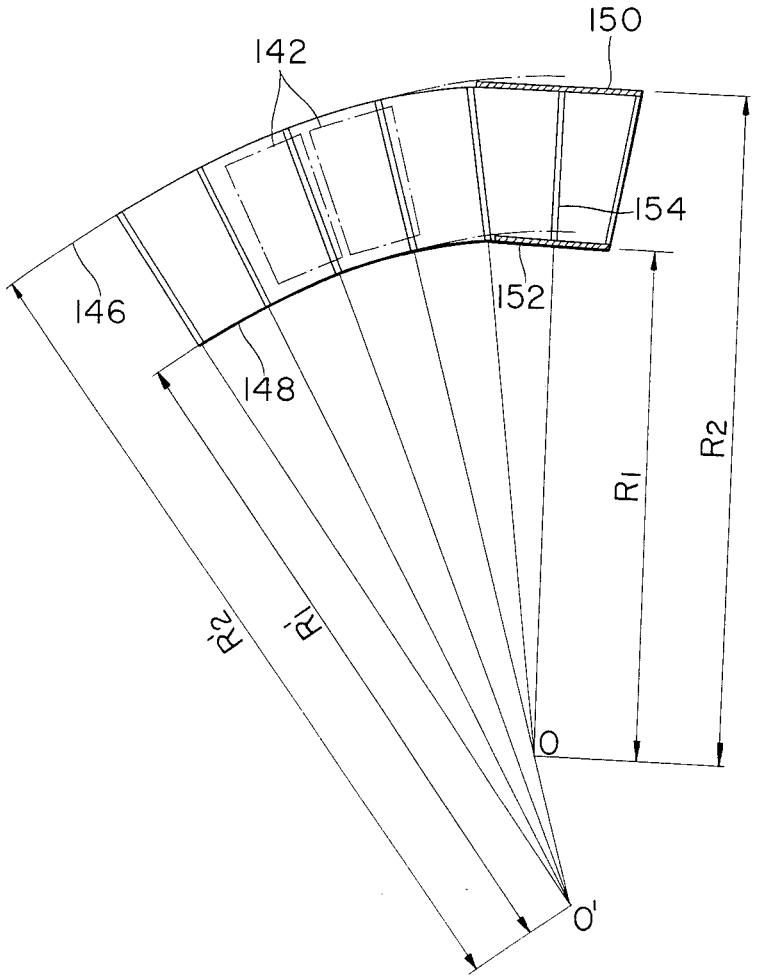
FIG. 22 is a graphical representation of the dimensions of the segment steps of a curved escalator according to the embodiment of FIG. 18 of the present invention.

As illustrated in FIG. 22, in the horizontal section of the endless belt, the inner chain 148 has a radius or curvature of $R'_1$ and the outer chain 146 has a radius of curvature of $R'_2$, and in the turn-around section of the endless belt, since the inner side edge of the steps 142 moves downward or toward the center line of the frame 128, the inner chain 148 has a radius of curvature in plan of $R_1$ which is smaller than $R'_1$ and the outer chain 146 has a radius of curvature in plan of $R_2$ which is smaller than $R'_2$.

According to the fourth embodiment of the curved escalator of the present invention, the cleats of the steps that engage in the intermediate and the horizontal sections disengage in the turn-around section of the endless belt, thereby allowing the steps to smoothly turn around along a compact conical surface with a simple turn-around mechanism.

What is claimed is:

1. A curved escalator comprising:

an inextensible endless belt means;

a plurality of segment steps of fixed width with an outer end and an inner end attached to said endless belt means;

means for driving said endless belt means in a loop disposed along a stairway path and means for guiding said belt means about said loop, said stairway path being curved in plan and having an intermediate section that has a predetermined constant slope angle, upper and lower landing sections that have substantially zero slope angle, and transition sections connecting said intermediate section to said upper or lower section that have sloping angles for smooth connection of the sections, said upper and lower horizontal sections being curved with constant radii of curvature about a center of curvature, said intermediate constant slope section being curved with constant radius of curvature about a center of curvature which is smaller than the radii of curvature of said upper and lower horizontal sections, and said upper and lower transition sections having radii of curvature about a center of curvature which gradually vary in accordance with the change in slope angle of said transition section, the center of curvature of the transition sections gradually shifting between the center of curvature of the intermediate constant slope section and the centers of curvature of the upper and lower horizontal sections such that the outer step end travels along a path having a radius related to the slope at the outer end determined by the relationship $$R_1(\theta_1)=(R_1(R_1-R_2)\cos\theta_1)/(R_1\cos\theta_1-R_2\cos\theta_2)$$

and the inner step end travels along a path having a path related to the slope at the inner end determined by the relationship $$R_2(\theta_2)=(R_2(R_1-R_2)\cos\theta_2)/(R_1\cos\theta_1-R_2\cos\theta_2)$$

where $R_1(\theta_1)$: radius of curvature of the outer end at an arbitrary position $R_2(\theta_2)$: radius of curvature of the inner end at an arbitrary position $R_1$: radius of curvature of the outer end at the upper and lower landing sections $R_2$: radius of curvature of the inner end at the upper and lower landing sections $\theta_1$: slope angle of the outer end $\theta_2$: slope angle at the inner end;

whereby the angular speed of the outer and inner ends of said steps is equal so that said belt means need not have the length adjusted.

2. A curved escalator as claimed in claim 1, wherein said segment steps each have an outer and an inner side edge that are concentric arcs expressed by $$l_1/l_2=R_1'/R_2'$$

where, $l_1$: length of the arc of the outer side edge of the step $l_2$: arc length of the inner side edge of the step $R_1'$: radius of curvature of the outer side edge of the step, $R_2'$: radius of curvature of the inner side edge of the step, a riser that is a portion of a truncated cone surface having a radius of curvature of $l_1$ at the outer side edge of the step and a radius of curvature of $l_2$ at the inner side edge of the step.

3. A curved escalator as claimed in claim 1 wherein said stairway path has turn-arounds at the ends thereof, and said endless belt means includes an endless inner chain disposed along the inner side of said curved stairway path and an endless outer chain disposed along the outer side of said curved stairway path, wherein said drive means include a turn-around mechanism having a large chain sprocket around which said outer chain is wound and a smaller chain sprocket around which said inner chain is wound, and wherein said guide means comprises a step axle mounted on each of said steps extending in the widthwise direction of the step, guide and trailing wheels mounted on said step axle and guided by said guide track, said guide tracks being positioned for guiding and guide and trailing wheels such that said steps are horizontally positioned while they are in the load bearing run and that said steps are moved along a truncated conical surface in the turn-around portion of said stairway path.

4. A curved escalator as claimed in claim 3, wherein said guide track means further include a guide track section which lifts the trailing rollers with respect to the leading rollers of the step by an amount sufficient to disengage the cleats formed on the adjacent steps.

5. A curved escalator as claimed in claim 3 wherein said step axle has mounted thereon a connecting plate connected at its opposite ends to chain links of said chain, the connecting ends of said connecting plate having formed therein a circular hole for receiving therein a pin of the chain link, said circular hole having a surface formed by rotating about the axis of the hole an arc which is convex toward the axis of the hole.

* * * * *